310-334

2/28/84 XR 4,433,916

United States Patent [19]

Hall

[11] 4,433,916

[45] Feb. 28, 1984

[54] ACOUSTIC RESONATOR HAVING TRANSDUCER PAIRS EXCITED WITH PHASE-DISPLACED ENERGY

[76] Inventor: Mark N. Hall, P.O. Box 162, College Place, Wash. 99324

[21] Appl. No.: 438,444

[22] Filed: Nov. 2, 1982

[51] Int. Cl.[3] ..... B01F 11/02

[52] U.S. Cl. ..... 366/114; 310/334; 366/127

[58] Field of Search ..... 366/114, 115, 127; 164/468, 499, 501, 504, 505, 511, 513; 310/334

[56] References Cited

U.S. PATENT DOCUMENTS

| | | | |
|---|---|---|---|
| 2,578,505 | 12/1951 | Carlin | 366/127 X |
| 3,167,669 | 1/1965 | Bodine, Jr. | 366/114 X |
| 3,168,660 | 2/1965 | Marks . | |
| 3,233,872 | 2/1966 | Bouyoucos | 366/114 |
| 3,399,314 | 8/1968 | Phillips . | |
| 3,761,732 | 9/1973 | Ratcliff . | |
| 3,771,286 | 11/1973 | Scott . | |
| 3,826,993 | 7/1974 | White . | |
| 3,872,330 | 3/1975 | Miller et al. . | |
| 3,949,349 | 4/1976 | Massa et al. . | |
| 4,016,926 | 4/1977 | Yamada et al. | 164/504 |
| 4,044,317 | 8/1977 | Newell et al. . | |
| 4,071,225 | 1/1978 | Holl | 366/127 X |
| 4,078,210 | 3/1978 | Lewis . | |
| 4,139,806 | 2/1979 | Kanber et al. | 310/334 X |
| 4,153,894 | 5/1979 | Alphonse et al. | 310/334 X |
| 4,168,295 | 9/1979 | Sawyer | 366/114 X |
| 4,205,966 | 6/1980 | Horikawa | 55/15 |
| 4,280,823 | 7/1981 | Szonntagh | 55/15 |

*Primary Examiner*—Philip R. Coe
*Attorney, Agent, or Firm*—Darrell E. Hollis

[57] ABSTRACT

An acoustic resonator apparatus for efficiently transmitting acoustic energy from a plurality of acoustic transducers to a fluid passing through a cylindrical shell. A plurality of pairs of acoustic transducers are mounted on the cylindrical shell, each transducer of a pair being 180° away from the other transducer of the pair, and each pair being associated with another transducer pair which is disposed 90° away from such pair. Each of the transducer pairs is excited with energy of the same frequency and magnitude, but transducer pairs which are disposed 90° from each other are excited with energy which is out of phase by 180°.

6 Claims, 6 Drawing Figures

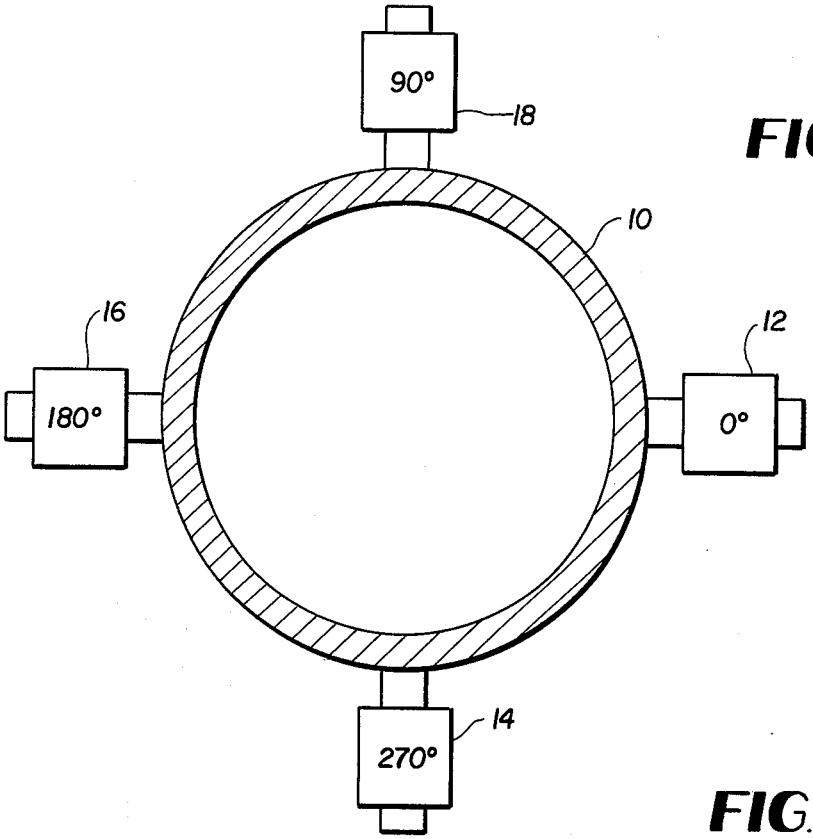
FIG.1
FIG.2
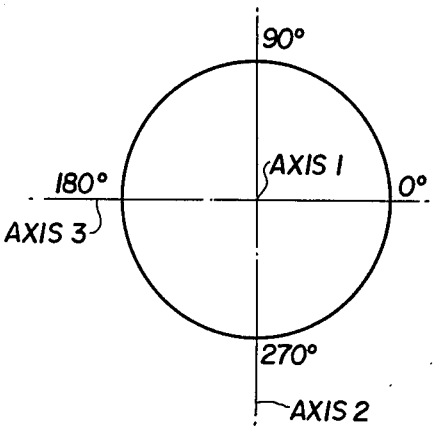
AXIS 1 + AXIS 2 + AXIS 3 = TRIAXIAL CONFIGURATION
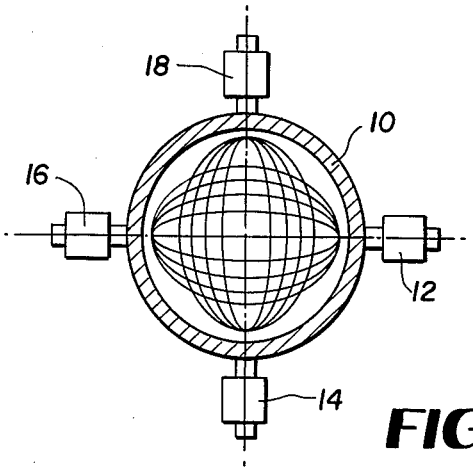
FIG.3

FIG. 4
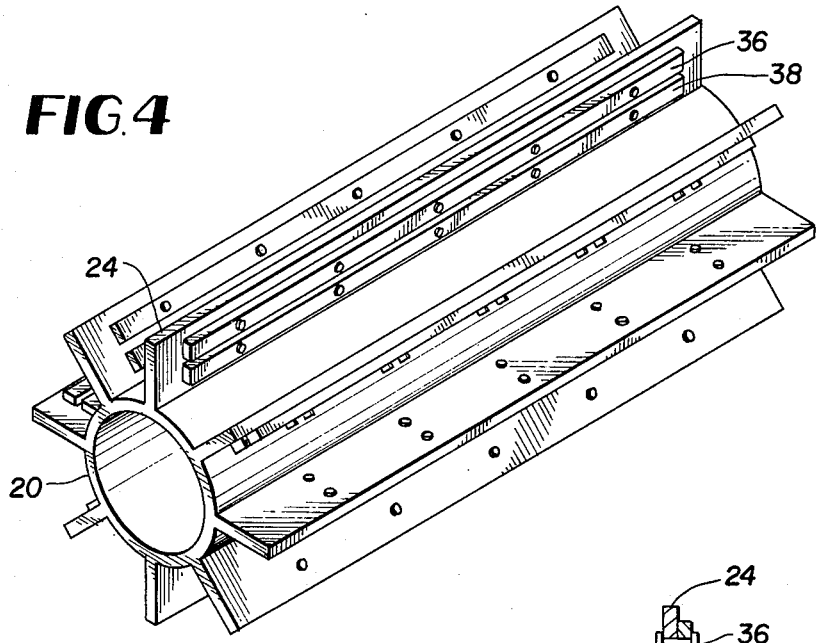
FIG. 5
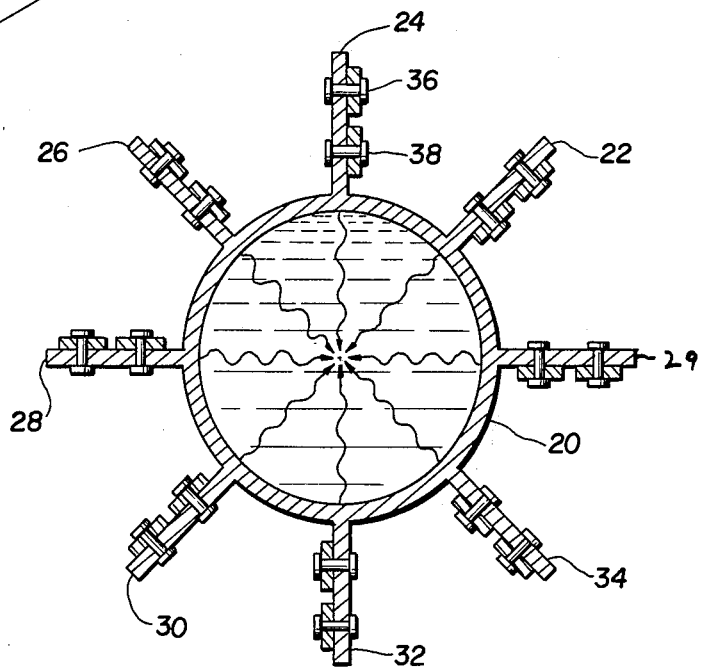
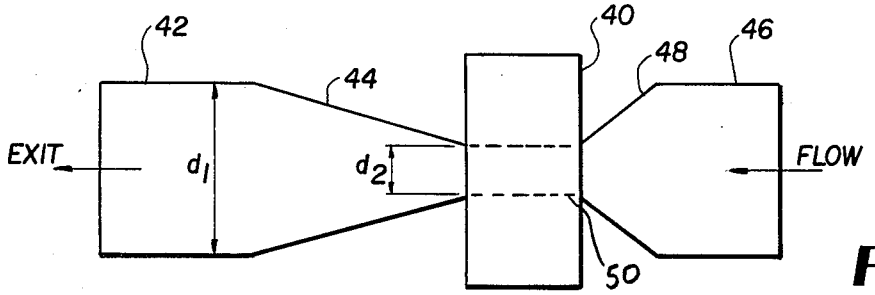
FIG. 6

ACOUSTIC RESONATOR HAVING TRANSDUCER PAIRS EXCITED WITH PHASE-DISPLACED ENERGY

STATEMENT OF GOVERNMENT INTEREST

The invention described and claimed herein may be manufactured and used by or for the Government of the U.S. of America for governmental purposes without the payment of royalties thereon or therefor.

BACKGROUND OF THE INVENTION

The present invention is directed to an improved acoustic resonator apparatus, and more particularly to an acoustic resonator apparatus for efficiently transmitting of acoustic energy from a plurality of acoustic transducer means to a fluid passing through a cylindrical shell.

It has been known for some time that agitation of a fluid by sonic or supersonic means produces desirable changes in the fluid. For example, among such desirable changes are destruction of bacteria, mixing ordinarily immiscible compounds, treating metals in their molten state to change crystal structure, and rapidly homogenizing liquids.

One method of attaining agitation has been to mount a plurality of acoustic transducers on a cylindrical shell, and pass the fluid through the shell. For example, U.S. Pat. No. 2,578,505 illustrates a prior art apparatus in cylindrical shell configuration while U.S. Pat. Nos. 3,761,732 and 4,139,806 disclose other acoustic resonating configurations.

As can be appreciated, it is desired to couple the acoustic energy to the medium in the shell as efficiently as possible. Prior art cylindrical shell resonators have used the monoaxial transmission method wherein transmission is accomplished by positioning transducers radially around the shell in an evenly distributed manner and operating all transducers in phase at a set frequency.

The main disadvantages of this approach are that the vibration transmission is partially cancelled by other vibration transmission in the shell due to longitudinal and radial wavelength mis-match and, since a cylindrical shell has its maximum resistance to deformation when pressure is applied uniformly about its circumference, when evenly spaced transducers are operated in phase, the uniformly applied pressure results in internal stresses and strains in the resonator, which negate a large portion of the acoustic transmission.

It is thus the principal object of the present invention to provide an apparatus for more efficiently transmitting acoustic energy from a plurality of acoustic transducer means to a medium passing through a cylindrical shell.

In accordance with the invention, the above object is accomplished by providing a cylindrical shell for containing a medium passing therethrough, and disposing a plurality of pairs of associated acoustic transducer means on the shell, with each pair being comprised of two transducer means 180° displaced from each other, and each pair being displaced 90° on the shell from its associated pair. Each pair of acoustic transducer means is excited with energy of the same frequency and magnitude as its associated pair but 180° displaced in phase. The result is eccentric deformation of the shell and efficient coupling of energy from the transducer means to the medium.

The invention will be better understood by referring to accompanying drawings in which:

FIG. 1 is a schematic representation of an embodiment of the invention.

FIG. 2 is a schematic representation illustrating the axes of the triaxial configuration of the embodiment of FIG. 1.

FIG. 3 is a schematic representation which illustrates the internal pulse path in the fluid being agitated.

FIG. 4 is a perspective view of a second embodiment of the invention.

FIG. 5 is a cross-sectional view of the embodiment of FIG. 4.

FIG. 6 is a schematic representation indicating a fluid flow system with which the invention may be utilized.

Referring to FIG. 1, the triaxial embodiment of the invention, in which four acoustic transducer means are utilized, is illustrated. Cylindrical shell 10 is constructed of high strength steel, thereby allowing a minimum of energy reduction due to internal damping. Acoustic transducer pair 12, 16 is provided wherein transducer 12 is at the 0° location on shell 10 while transducer 16 is 180° displaced therefrom. A second acoustic transducer pair 18, 14 is also disposed on the shell wherein transducer 18 is at the 90° location on the shell and transducer 14 is at the 270° location. In FIG. 2, the derivation of the nomenclature "triaxial configuration" is illustrated, as it is seen that axis 1 is the axis of cylindrical shell 10 while axes 2 and 3 are lines connecting the transducers of each respective transducer pair.

In accordance with the invention, transducer pair 12, 16, is excited with energy which is 180° out of phase with that exciting transducer pair 18, 14. The energy exciting all of the transducers is of the same magnitude and frequency. The result is the elliptical pulse pattern illustrated in FIG. 3, wherein the shell deforms in eccentric fashion, inverting its nodes every half cycle. By using the arrangement of the invention, energy is coupled to the fluid flowing in shell 10 more efficiently than it all of the transducers are operated in phase. As indicated above, in the in-phase condition, the cylindrical shell has its maximum resistance to deformation, and energy is dissipated in the internal stresses and strains in the shell.

The invention is not limited to utilizing two pairs of transducers, but rather an arbitrary, even number of pairs may be used. The required condition is that each pair be associated with another pair which is physically displaced 90° on the shell from such pair, and which is excited with energy of the same frequency and magnitude, but phase displaced by 180° from the energy with which such pair is excited.

In FIGS. 4 and 5, a quinaxial embodiment is depicted. As is illustrated, cylindrical shell 20 has four pairs of acoustic transducer means disposed thereon. Each such means is comprised of a fin, such as fin 24, on which is mounted two acoustic transducers, such as 36 and 38. Each such transducer is a well known magnetostrictive or piezoelectric transducer means.

As shown in FIG. 5, transducer pairs 29, 28 is disposed 90° from pair 24, 32 while transducer pair 22, 30 is disposed 90° from pair 26, 34. Transducer pair 24, 32 is excited with energy which is phase displaced 180° from the energy with which pair 29, 28 is excited, while transducer pair 26, 34 is excited with energy which is displaced 180° in phase from the energy with which transducer pair 22, 30 is excited. The frequency and magnitude of the excitation energy for all transducers is the same.

FIG. 6 is a schematic illustration of a flow arrangement incorporated the resonator of the invention. In the Figure, numeral 40 denotes a housing in which the resonator is enclosed, while inlet pipe 46 and exit pipe 42 have a diameter $d_1$ which is larger than the diameter $d_2$ of the cylindrical shell 50. A conical section 48 of decreasing diameter connects inlet pipe 46 with cylindrical shell 50 while a conical section 44 of increasing diameter connects shell 50 with exit pipe 42. The Venturi design permits the cylindrical shell and feedpipe to be of different diameter and also creates a low pressure condition in the shell which is favorable in that it takes less acoustic pressure to degass the fluid when under less internal loading.

The metals which may be used for the resonator vary with particular design, but in general high strength spring, carbon, or alloy steel, such as ball-bearing steel should be utilized. Stainless steel may also be acceptable, but because of its lower K value, it should be restricted only to certain applications.

While I have described certain embodiments of my invention, it should be understood that I do not intend to be limited thereto, but rather intend to cover all variations which fall within the scope of the invention, which is limited only the claims appended hereto and equivalents.

I claim:

1. An acoustic resonator apparatus for transmitting acoustic energy from a plurality of acoustic transducer means to a medium passing through a cylindrical shell, comprising:

a cylindrical shell for containing a medium passing therethrough;

a plurality of pairs of acoustic transducer means mounted on said shell, each said pair being comprised of two transducer means 180° displaced from each other on said shell, and each said pair being displaced 90° on said shell from another pair; and means for exciting each pair of transducer means with energy of the same frequency as each other pair but 180° displaced in phase from the energy with which the pair which is 90° displaced on said shell from such pair is excited, whereby relatively efficient coupling from said transducer means to said medium is effected.

2. The apparatus of claim 1, wherein said means for exciting comprises means for exciting each pair of transducer means with energy of the same magnitude.

3. The apparatus of claim 2 wherein said plurality of pairs of transducer means comprises two pairs.

4. The apparatus of claim 2 wherein said plurality of pairs of transducer means comprises four pairs.

5. The apparatus of claim 2 wherein said medium is a fluid, further comprising, an inlet fluid flow pipe for feeding said cylindrical shell, an outlet fluid flow pipe for providing egress from said fluid shell, said inlet and outlet pipes being of greater diameter than said shell, and said inlet pipe being connected to said shell by a converging conical pipe section and said shell being connected to said outlet pipe by a diverging conical pipe section.

6. The apparatus of claim 2 wherein said cylindrical shell is made of steel.

* * * * *